United States Patent [19]

Swanson

[11] Patent Number: 4,499,446

[45] Date of Patent: Feb. 12, 1985

[54] PRESSURE-OPERATED SWITCH FOR A HIGH-VOLTAGE INTERRUPTING MODULE

[75] Inventor: Roy T. Swanson, North Riverside, Ill.

[73] Assignee: S&C Electric Company, Chicago, Ill.

[21] Appl. No.: 525,205

[22] Filed: Aug. 22, 1983

[51] Int. Cl.[3] ..... H01H 39/00

[52] U.S. Cl. ..... 337/30; 337/221; 337/401

[58] Field of Search ..... 337/6, 30, 143, 158, 337/221, 401, 402, 409

[56] References Cited

U.S. PATENT DOCUMENTS

| | | | |
|---|---|---|---|
| 3,118,986 | 1/1964 | Lewis et al. | 337/409 X |
| 3,239,631 | 3/1966 | Snell | 337/30 |
| 3,291,937 | 12/1966 | Carothers et al. | 337/30 |

*Primary Examiner*—George Harris

*Attorney, Agent, or Firm*—John D. Kaufmann

[57] ABSTRACT

An improved switch for a high-voltage device in which ignition of a power cartridge generates pressure at one end of an insulative piston to move the piston, located in a conductive member, into a passageway in an insulative liner, said piston moving a contact through the passageway and away from the conductive member to break an electrical interconnection between the conductive member and the movable contact, an insulative lip seal located in the bore between the power cartridge and the one end of the piston, the lip seal being movable with the piston and being conformally force-fit into the bore, and means limiting movement of the lip seal through the bore so that the lip seal remains in the bore after the switch is open restricting the flow of the ignition products of the power cartridge.

19 Claims, 7 Drawing Figures

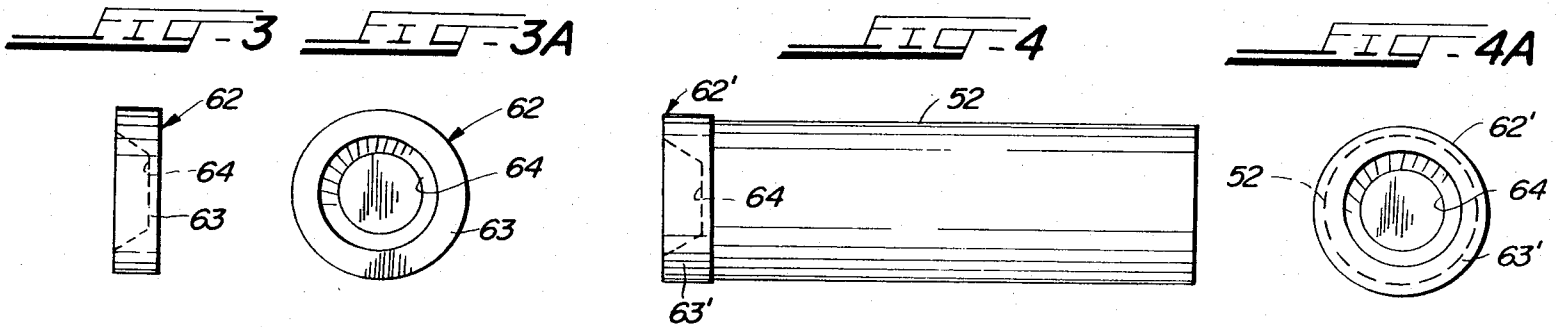
FIG-4A
FIG-4
FIG-3A
FIG-3
62'
64
63'
52
62
63
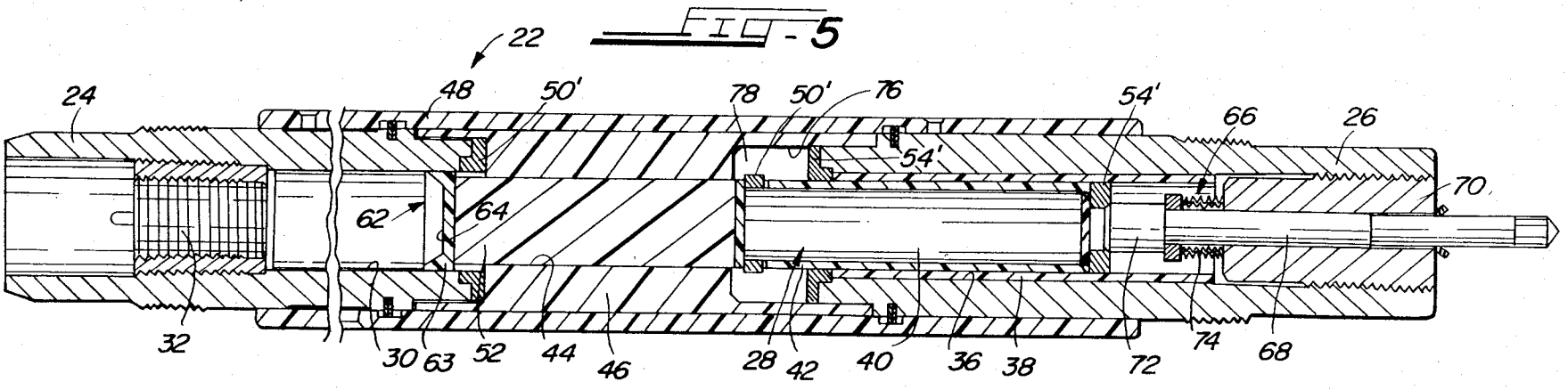
FIG-5
22
24
26
28
30
32
36
38
40
42
44
46
48
50'
52
54'
62
63
64
66
68
70
72
74
76
78

PRESSURE-OPERATED SWITCH FOR A HIGH-VOLTAGE INTERRUPTING MODULE

BACKGROUND OF THE INVENTION

1. Field of the Invention

The present invention relates to an improved pressure-operated switch for a high-voltage interrupting module. More specifically, the present invention relates to an improvement of the switches disclosed in commonly assigned U.S. Pat. Nos. 4,342,978, issued Aug. 3, 1982 in the name of Meister, and 4,370,531, issued Jan. 25, 1983 in the name of Tobin, and in the following commonly assigned U.S. patent applications: Ser. No. 179,367, filed Aug. 18, 1980 (now abandoned in favor of continuation application Ser. No. 550,201, filed Nov. 9, 1983) in the name of Jarosz and Panas; Ser. No. 179,366, filed Aug. 18, 1980 (now abandoned in favor of continuation application Ser. No. 539,396, filed Oct. 6, 1983) in the name of O'Leary, and Ser. No. 437,925, which issued Jan. 24, 1984 as U.S. Pat. No. 4,227,963, and 437,926 both filed Nov. 1, 1982 in the names of Jarosz and Panas.

2. Prior Art

The above patents and patent applications relate to various aspects of a pressure-operated switch and to a high-voltage interrupting module containing the switch. The switch may include a pair of contacts, which are normally electrically interconnected, for example, by direct abutment therebetween or, preferably, by interconnecting them with a shearable or tearable metallic disc or membrane. In preferred embodiments of the switch, one contact is stationary, while the other is movable, although both may be movable. The contacts are separable by their relative movement apart along a fixed line of direction to open a gap therebetween, thereby opening the switch. One of the contacts, preferably the stationary contact, contains a bore which, in conjunction with a piston or trailer between the movable contact and the bore, defines a closed chamber. The chamber houses a power cartridge or similar pressure-generating device.

The switch may be in electrical shunt with a fuse, a fusible element of which, as well as the switch, preferably reside within a common housing. When the switch is closed (i.e., when the contacts thereof are electrically interconnected), the resistance of the current path through the switch is much lower than the resistance of the current path through the fusible element, and, accordingly, a majority of the current flowing through the module flows through the switch. Thus, the module has a very high continuous current rating. Upon opening the switch, the contacts separate and current is rapidly commutated from the switch to the fusible element where it is interrupted. Separation of the contacts is achieved by igniting the power cartridge, which evolves high pressure within the chamber. This high pressure acts against the piston and the forces produced thereby rapidly drive the piston and the movable contact away from the stationary contact, which shears the disc to break the normal electrical interconnection and open the switch. The power cartridge may be ignited in response to a trip signal produced by apparatus which senses a fault current or other over-current in a circuit in which the interrupting module is connected for protection thereof. Such trip-signal-producing apparatus may be that which is disclosed in commonly assigned U.S. patent application, Ser. Nos. 506,942; 506,943; and 506,944, all filed June 22, 1983 in the name of Ruta.

In more specific embodiments of the switch described in the above patents and patent applications, a second stationary contact is included. When the switch is closed, the movable contact and the second stationary contact are electrically interconnected with a second shearable disc. When the power cartridge is ignited, movement of the movable contact also shears the second disc. As the movable contact moves away from the first stationary contact, it is telescoped into a bore formed in the second stationary contact. This bore may be lined with an insulative sleeve and the movable contact may be covered with an insulative sleeve, so that such telescoping results in the formation of a second gap, that is, a gap between the movable contact and the second stationary contact.

The movable contact moves rapidly away from the first stationary contact through a passageway in an insulative liner which the piston may also enter. The piston also enters the passageway in the liner to physically isolate the moving contact and the second stationary contact from the ignition products of the power cartridge. This isolation prevents or suppresses the formation of any arc between the separating contacts and between the stationary contacts. In preferred embodiments of the switch, the stationary contacts and the liner are engageably surrounded, and have their relative positions fixed, by an insulative housing, which maintains the stationary contact and the liner end-to-end with the bores and the passageway axially aligned.

Tests in low temperature environments (e.g., −40°) of earlier versions of the switch (such as those disclosed in '978 and '531 patents and in the '367 and '366 applications) showed that, after the piston entered the liner, some of the ignition products of the power cartridge could flow along the housing-liner interface. Such flow could create the possibility of internal flashover of the open switch, i.e., undesired conduction between the stationary contacts. One object of the present invention is to eliminate such ignition product flow along the housing-liner interface.

It also appeared that in such earlier versions of the switch, ignition products could flow along the piston-liner interface, creating the possibility of internal flashover between the stationary contacts. On the assumption that this latter flow was caused by abrasion or distortion of the piston or the liner (or both) as the switch opened, both elements were made of abrasion-resistant, high surface lubricity, non-brittle, thus high molecular weight polyethylene (UHMWPE), as disclosed in the ]926 application. Tests of later versions of the switch showed that this ignition-product flow problem, though ameliorated by the UHMWPE piston and liner nevertheless could, in some cases, remain. Specifically, if manufacturing tolerances led to the passageway in the UHMWPE liner being too large or to the UHMWPE piston being too small, there could be sufficient clearance therebetween to permit flow of the ignition products therepast. Such flow could produce a conductive path between the first stationary contact and the second stationary contact. Additionally, if the UHMWPE piston were intentionally oversized so that its rapid entry into the UHMWPE liner constituted a conformal force fit, at times either the switch might fail to fully open due to jamming of the piston in the liner, or if it did open, either such opening could be too slow (due to high friction between the piston and the liner) to properly commutate current to the fusible element or the piston or liner could become sufficiently deformed to allow undesirable ignition product flow. One solution to this latter ignition-product-flow problem may be found in commonly assigned and filed U.S. patent application Ser. No. 524,181, filed Aug. 17, 1983 in the name of Jackson. It is another object of the present invention to eliminate the latter flow problem, the structure hereof being usable in place of or in addition to the invention of the 524,181 application.

SUMMARY OF THE INVENTION

With the above and other objects in view, the present invention contemplates an improved switch for a high-voltage device. The switch improved hereby is of the general type in which ignition of a power cartridge generates pressure at or near one end of an insulative piston to move the piston, which is normally located in a bore formed in a conductive member, away therefrom and into a passageway formed in an insulative liner. Movement of the piston moves a movable contact through the passageway and away from the conductive member to break an electrical interconnection between the conductive member and the movable contact. The breaking of this electrical contact opens the switch. The bore and the passageway are aligned.

In the improved switch, an insulative lip seal is located in the bore between the power cartridge and the one end of the lip seal. The lip seal is movable with the piston and is conformally force fit into the bore. Facilities are provided for limiting movement of the lip seal through the bore so that the lip seal remains in the bore after the switch is opened. The force fit of the lip seal in the bore restricts or prevents the flow of the ignition products of the power cartridge therepast.

The lip seal and the piston may be separate members. Alternatively, the lip seal may be formed integrally with the piston at the one end thereof. The lip seal is made of a material having high abrasion resistance, high surface lubricity and lack of brittleness. Preferred materials for the lip seal are polymethylpentene and ultra high molecular weight polyethylene.

In a specific embodiment, the lip seal contains a blind bore facing the power cartridge. As a consequence, ignition of the power cartridge applies force to the blind bore which outwardly expands the lip seal and the outside thereof into continuous, firm engagement with the bore. Preferably, the wall of the blind bore is tapered. The lip seal may be otherwise configured in any desirable fashion as long as ignition of the power cartridge applies force thereto which outwardly expands the lip seal into continuous firm engagement with the first bore.

BRIEF DESCRIPTION OF THE DRAWING

FIGS. 3 and 3*a* are a front elevation and a side elevation, respectively, of a lip seal according to the present invention and depicted in FIG. 2;

FIGS. 4 and 4*a* are a front elevation and a side elevation, respectively, of an alternative to the embodiment of the present invention shown in FIGS. 2, 3 and 3*a*, and specifically of a piston having an integral lip seal; and FIG. 5 is a partially sectioned view of a portion of the switch of FIG. 2 after opening thereof.

DETAILED DESCRIPTION

Figure 1:
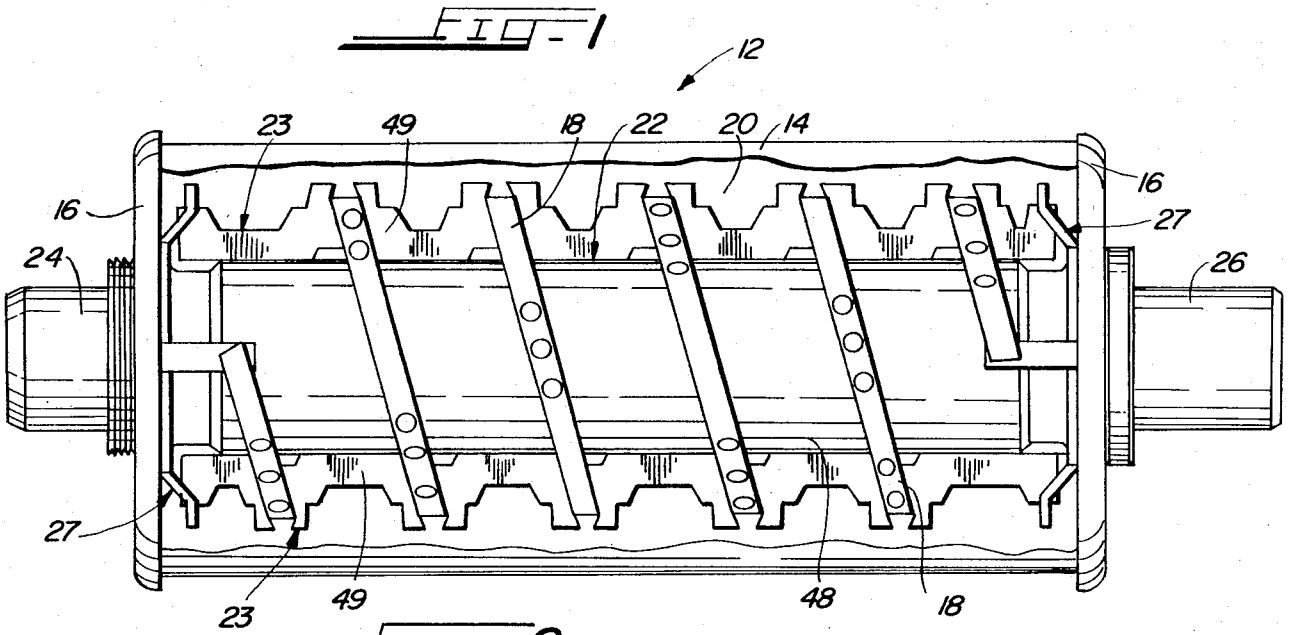
FIG. 1 is a front elevation of a portion of an interrupting module which includes an improved switch according to the present invention.

The present invention issued with an interrupting module 12. Because the module 12 is more completely described in the above United States patents and patent applications, it is only generally depicted in the drawing hereof and only generally described herein.

Referring to FIG. 1, the module 12 includes a generally cylindrical open-ended insulative housing 14, which is closed by end plates 16. The housing and end plates 14 and 16 surround a fusible element 18 helically wound around a central axis of the housing 14 and may also surround a mass of a particulate fulgurite-forming medium, such as silica sand. The medium is in intimate engagement with the fusible element 18. The fusible element 18, which may be silver or copper, and the sand 20 interrupt fault currents or other overcurrents therethrough in a current-limiting or energy-limiting manner, according to well-known principles. The fusible element 18 may be similar to those disclosed in commonly assigned U.S. Pat. No. 4,359,708 issued Nov. 16, 1982, U.S. patent application Ser. No. 437,776 filed Oct. 29, 1982, both in the names of Jarosz and Panas.

The housing 14 also surrounds a switch 22 around which the fusible element 18 may be maintained in its helical configuration by insulative supports 23, such as those disclosed in commonly assigned U.S. patent application, Ser. No. 181,603 filed Aug. 27, 1980 in the names of Jarosz and Panas.

Figure 2:
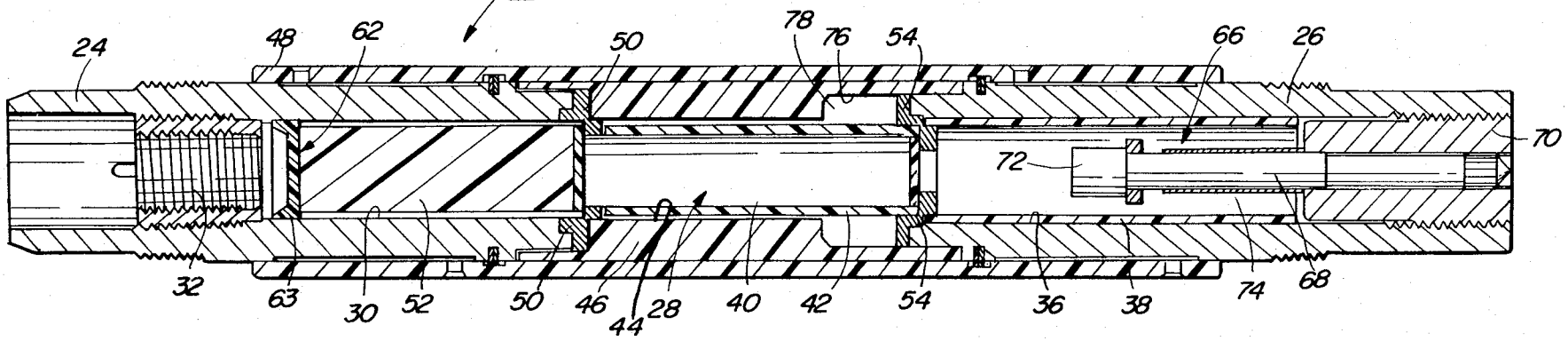
FIG. 2 is a partially sectioned front elevation of a portion of FIG. 1 which shows in greater detail the improved switch hereof in its closed position.

The switch 22, which is improved by the present invention, may be generally constructed in accordance with the above U.S. patents and patent applications and an example thereof is depicted in FIGS. 1, 2, and 5. Specifically, the switch 22 includes a first conductive member 24, to which the left end plate 16 is attached and a second conductive member 26, to which the right end plate 16 is attached. The first conductive member 24 serves as a first stationary contact of the switch 22, while the second conductive member 26 serves as a second stationary contact of the switch 22. The ends of the fusible element 18 may be rendered electrically continuous with the stationary contacts 24 and 26 by facilities 27 described more fully in commonly assigned U.S. patent application Ser. No. 439,444 filed Nov. 5, 1982 in the name of Jarosz.

The switch 22 also includes a movable contact 28 (FIGS. 2 and 5). Normally, the movable contact 28 is electrically continuous with both stationary contacts 24 and 26 so that a continuous low-resistance electrical path is formed between the members 24 and 26 via the movable contact 28. Because the resistance of this path is lower than the resistance of the fusible element 18 while the switch 22 is closed, as depicted in FIG. 2, the majority of the current flowing through the module 12 is normally shunted through the switch 22 and away from the fusible element 18. When the switch 22 opens, as described below, the current formerly flowing through the stationary contacts 24 and 26 and the movable contact 28 is commutated to the fusible element 18 for interruption.

As shown in FIGS. 2 and 5, the first stationary contact 24 has a central bore 30. At the left end of the central bore 30, a power cartridge 32 or other pressure-generating device is located. The second stationary contact 26 also contains a central bore 36. This bore 36 may be lined with an insulative sleeve 38.

The movable contact 28 comprises a conductive member 40 surrounded by an insulative sleeve 42. The movable contact 28 is normally located between the stationary contacts 24 and 26 and within a passageway 44 formed through an insulative liner 46 between the stationary contacts 24 and 26.

The stationary contacts 24 and 26 with the liner 46 therebetween are held with the bores 30 and 36 and the passageway 44 aligned by an insulative housing 48 which engageably surrounds the stationary contacts 24 and 26 which are affixed thereto in a convenient manner. If desired, the liner 46 may be associated with the stationary contacts 24 and 26 pursuant to commonly assigned and filed U.S. patent application Ser. No. 525,516, filed Aug. 17, 1983 in the name of Swanson, and the stationary contacts 24 and 26 may be affixed to the housing 48 pursuant to commonly assigned and filed U.S. patent application Ser. No. 524,180, filed Aug. 17, 1983 in the names of Jackson and Scherer. As shown in FIG. 1, the insulative support 23 may comprise a pair of notched fins 49, and the fusible element 18 may be helically maintained about the housing 48 by the fins 49, as described in commonly assigned U.S. patent application, Ser. No. 181,603 filed Aug. 27, 1980 in the names of Jarosz and Panas.

With the movable contact 28 occupying the position shown in FIG. 2, the conductive member 40 thereof is electrically interconnected to the stationary contact 24 by a conductive shear disc 50 or other metallic diaphragm or member, which is shearable, tearable or the like. To the left of the diaphragm 50 is located an insulative piston or trailer 52. In the normal position of the movable contact 28 shown in FIG. 2, the piston 52 normally occupies the bore 30 in the first stationary contact 24, and the movable contact 28 occupies the passageway 44 in the liner 46.

The right end of the conductive member 40 is normally electrically interconnected to the second stationary contact 26 by a shear disc 54, which may be similar to the shear disc 50. The interior of the insulative sleeve 38 is sufficiently large to receive the conductive member 40 with its insulative sleeve 42 thereon. The passageway 44 of the liner 46 can receive both the conductive member 40 with the insulative sleeve 42 thereon and the trailer 52.

In the normal condition of the module 12, as shown in FIG. 2 and as previously described, the switch 22 carries a majority of the current flowing in a protected high-voltage circuit (not shown) to which the module 12 is connected. This current flows through the stationary contacts 24 and 26, the discs 50 and 54, and the movable contact 28. Little current normally flows through the fusible element 18. Should a fault current or other overcurrent occur in the protected circuit (not shown) to which the module 12 is connected, apparatus (not shown) detects this condition and ignites the power cartridge 32. Ignition of the power cartridge 32 causes it to evolve large quantities of high-pressure gas which acts on the left end of the piston 52. The force applied to the piston 52 by the high pressure moves the piston 52 rightwardly and also moves rightwardly the movable contact 28 (i.e., the conductive member 40 with the insulative sleeve 42 thereon). Rightward movement of the piston 52 and of the movable contact 28 severs, rips or tears the discs 50 and 54, thereby breaking the electrical interconnection between the movable contact 28, on the one hand, and both stationary contacts 24 and 26, on the other hand, as shown in FIG. 5. The shearing of the discs 50 and 54 produces two portions 50'—50' and 54'—54' thereof. Two gaps are thereby opened by the switch 22. The first gap exists between the left end of the conductive member 40 and the right end of the first stationary contact 24, while the second gap exists between the right end of the conductive member 40 and the left end of the second stationary contact 26. Both gaps are electrically insulated. Specifically, the first gap is electrically insulated by the reception of the piston 52 within the passageway 44 in the liner 46. The second gap is electrically insulated by the reception of the insulative sleeve 42 within the bore 36 of the insulative sleeve 38. The reception of the piston 52 by the passageway 44 in the liner 46 is also intended to isolate the movable contact 28 and the stationary contact 26 from the ignition products of the power cartridge 32, which may contain electrically conductive, arc-promoting materials.

When the switch 22 opens (FIG. 5), the current previously flowing therethrough is commutated to the fusible element 18. The action of the fusible element 18 and of the silica sand 20 ultimately extinguishes this current, as is well known.

After numerous experiments with the module 12 as described above, it was found that in low temperature environments, after the switch 22 opened, the ignition products of the power cartridge 32 could, in some cases, flow along the interface between the liner 46 and the housing 48. Such flow could occur notwithstanding an original close fit and the use of adhesives between the liner 46 and the housing 48, possibly due to the different coefficients of thermal expansion of these elements. Referring to FIG. 5, it may be seen that if such ignition products flow out of the bore 30 and past the piston 52, they may possibly flow along the liner-housing 46–48 interface from the liner-contact 46–24 abutment. Because these ignition products contain conductive elements and are hot, such flow might, at times, reinitiate current conduction between the stationary contacts 24 and 26. This reinitiated current flow may either re-shunt current away from the fusible element 18 (preventing the desired interruption thereby) or re-initiate current flow in the protected circuit after interruption thereof by the fusible element 18 (defeating successful interruption).

Further, it has been found that the ignition products may, in some cases, flow along the interface between the piston and liner 52 and 46 after the switch 22 opens. Such flow has the same possible deleterious consequences as the flow along the liner-housing 46–48 interface.

According to the present invention, and as shown in FIGS. 2–5, both flow problems may be lessened or prevented by providing a lip seal 62 on or at the end of the piston 52 proximal to the power cartridge 32. As shown in FIGS. 2, 3, 3*a* and 5, the lip seal 62 is preferably separate from the piston 52 and comprises an insulative body 63 containing a blind bore 64 formed in the end of the body 63 proximal to the power cartridge 32. Preferably the side wall of the blind bore 64 is slanted or flared as shown so that pressure-produced forces acting thereon tend to deform or flare the exterior of the body 63 outwardly. When the switch 22 is closed, the right end of the body 63 rests against the left end of the piston 52. There need be no attachment between the body 63 and the piston 52, thereby decreasing assembly costs, since ignition of the power cartridge 32 simultaneously moves the lip seal 62, the piston 52 and the contact 28 rightwardly. Afternatively, the lip seal 62 and the piston 52 may be attached, or as shown in FIGS. 4 and 4*a*, the lip seal 62' may comprise an enlargement 63' integral with the piston 52, which is otherwise similar to the lip seal 62 of FIGS. 2, 3, 3*a* and 5.

Where the bores 30 and 36, the passageway 44, the piston 52 and the contact 28 have the preferred circular cross-sections, the lip seal 62 or 62' also has a circular cross-section. The free diameter of the lip seal 62 or 62' is larger than the diameter of the bore 30, and in assembling the switch 22, the lip seal 62 or 62' is force fit into the bore 30. When the power cartridge 32 is ignited, the pressure of its ignition products acts on the lip seal 62 or 62' to move it, the piston 52 and the movable contact 28 rightwardly (going from FIG. 2 to FIG. 5). As such movement occurs, the pressure to the left of the lip seal 62 or 62' acts on the side wall of the blind bore 64, urging the exterior of the body 63 or enlargement 63' into sealing engagement with the bore 30. This sealing engagement has been found to occur whether or not the lip seal 62 or 62' takes a permanent "set" after being force fit into the bore 30.

The sealing engagement increases the efficiency of the power cartridge 32 in moving the piston-contact combination 52–28 rightwardly and resists or prevents the flow of the ignition products past and to the right of the interface between the lip seal and the bore 62 and 30 or 62' and 30'. Moreover, as shown in FIG. 5, when the switch 22 is fully open, the piston 52 and the contact 28 assume positions whereat the lip seal 62 or 62' continues to reside within the bore 30. Thus, the lip seal 62 continues to restrict or prevent the flow of the ignition rightwardly therepast after current is commutated to the fusible element 18. Because the ignition products of the power cartridge 32 are restricted or prevented from flowing to the right of the lip seal 62 or 62' in all positions of the piston 52, there is little, if any, amount of ignition products available to flow along the piston-liner 52–46 interface or along the liner-housing 46–48 interface from the liner-contact 46–28 abutment. Judicious selection of the material of the lip seal 62 or 62' ensures that pressure to the left thereof effects the force-fit sealing engagement thereof with the bore 30 regardless of the temperature at which the switch 22 is used. For reasons set forth in the Ser. No. 524,181 application, it is preferred that the piston 52 be made of polymethylpentene(4-methyl-pentene-1-based polyolefin) a thermoplastic sold under the trade name TPX by Mitsui Petrochemical Industires, Ltd. In some use environments, TPX is also an appropriate material for the lip seal 62 or 62', in which event the integral piston 52 and the lip seal 62' may be used. When the switch 22 is used at low temperatures (down to −40°), it is preferred that the separate lip seal 62 made of ultra high molecular weight polyethylene (UHMWPE) be used. It has been found that when the integral lip seal 62' made of TPX is used at very low temperatures, pressure thereon, following ignition of the power cartridge 32 may shatter, fracture or crack it.

The lip seal 62 or 62' may be made of any material having the following properties, due regard being given to the temperature at which the switch 22 is to be used: high abrasion-resistance, high surface lubricity, lack of brittleness, and ability to seal against the bore 30. If desired, the material of the lip seal 62 or 62' may also possess high dielectric strength and good anti-tracking properties.

The continuous presence of the lip seal 62 or 62' within the bore 30 after the switch 22 opens may be achieved by appropriate selection of the axial lengths of the various elements of the switch 22, as well as by the use of a brake 66 for the piston-contact 52–28 combination, as described in the '925 application. Briefly, the brake 66 may include a pin 68 slidable in a plug 70 closing the bore 36 of the second stationary contact 26. Loosely surrounding the pin 68 between a head 72 thereof and the plug 70 is a collapsible sleeve 74. When the right end of the movable contact 28 moves against the head 72 of the pin 68, the pin 68 is moved rightwardly and the sleeve 74 is collapsed between the head 72 and the plug 70. Such collapse dissipates the kinetic energy of the piston-contact combination 52–28 and abutment between the fully collapsed sleeve 74 and both the head 72 and the plug 70 halts movement of the piston 52 and the movable contact 28. As noted, cessation of movement of the contact 28 occurs so that the lip seal 62 or 62' remains in the bore 30, which may be achieved by selecting appropriate lengths for the pin 68, the head 72 and the sleeve 74 to the left of the plug 70.

The presence of the enlargement 62 within the bore 30 restricts the flow of the ignition products therepast. Thus, even if the interfaces between the piston 52 and the liner 46 and between the liner 46 and the housing 48 are not gas-tight—due to use of the switch 22 in low temperature environments or otherwise—the lip seal 62 or 62' substantially eliminates the presence of ignition products from such interfaces. The lip seal 62 or 62' of the present invention may be used with or in place of the invention disclosed in Ser. No. 524,181—which restricts or prevents ignition product flow along the piston-liner 52–46 interface—or the invention disclosed in Ser. No. 525,516—which restricts or prevents ignition product flow along the liner-housing 46–48 interface. If the lip seal 62 or 62' is used with these latter two inventions, undesirable ignition product flow is more assuredly achieved at normal temperatures and is ensured at low temperatures.

In a specific example of the present switch 22, the diameters of the bore 30, the passageway 44, the piston 52, and the lip seal 62 usable at 5 to 38 kv may be within several thousandths of an inch of 0.750 inch, with the diameter of lip seal 62 exceeding the diameter of bore 30, the diameter of bore 30 exceeding the diameter of piston 52, and the diameter of piston 52 exceeding the diameter of passageway 44.

As set forth in the '926 application, the passageway 44 of the liner 46 may be relieved, undercut or diametrically increased in size, as shown at 76. This provides a relief cavity or volume 78. Should interruption of a fault current or other overcurrent by the fusible element 18 generate sufficient heat to cause undue expansion of the liner 48 or the piston 52, the relief cavity or volume 78 provides a space into which the material of these elements can expand. Such expansion into the relief cavity or volume 78 prevents outward forces or pressure from being applied to the housings 14 and 48, to the end plates 16, and to the stationary contacts 24 and 26, thus ensuring that the module 12 remains integral during and following operation thereof.

With these advantages and features in mind, it should be apparent that various changes, alterations, and modifications may be made to the preferred embodiment of the present invention as described herein, without departing from the spirit and scope of the present invention as defined in the appended claims.

I claim:

1. An improved switch for a high-voltage device, the switch being of the type in which ignition of a power cartridge generates pressure at one end of an insulative piston to move the piston, which is normally located in a bore formed in a conductive member, away therefrom and into a passageway formed in an insulative liner, such movement of the piston moving a movable contact, through the passageway and away from the conductive member to break an electrical interconnection between the conductive member and the movable contact, thereby opening the switch; the bore and the passageway being aligned; wherein the improvement comprises:

an insulative lip seal located in the bore between the power cartridge and the one end of the piston, the lip seal being movable with the piston and being conformally force-fit into the bore, and means for limiting movement of the lip seal through the bore so that the lip seal remains in the bore after the switch is open, the force-fit of the lip seal in the bore restricting or preventing the flow of the ignition products of the power cartridge therepast.

2. An improved switch as in claim 1, wherein the lip seal and the piston are separate members.

3. An improved switch as in claim 2, wherein the lip seal abuts the one end of the piston.

4. An improved switch as in claim 3, wherein the lip seal is made of ultra high molecular weight polyethylene.

5. An improved switch as in claim 3, wherein the piston is made of polymethylpentene, and the liner is made of ultra high molecular weight polyethylene.

6. An improved switch as in claim 1, wherein the lip seal is formed integrally with the piston at the one end thereof.

7. An improved switch as in claim 6, wherein the piston and the lip seal are made of polymethylpentene.

8. An improved switch as in claim 7, wherein the liner is made of ultra high molecular weight polyethylene.

9. An improved switch as in claim 1, wherein the lip seal is made of a material having high-abrasion resistance, high surface lubricity and lack of brittleness.

10. An improved switch as in claim 9, wherein the lip seal is made of polymethylpentene or ultra high molecular weight polyethylene.

11. An improved switch as in claim 1, wherein the lip seal contains a blind bore facing the power cartridge so that ignition of the power cartridge applies force to the blind bore which outwardly expands the lip seal and the outside thereof into continuous, firm engagement with the bore.

12. An improved switch as in claim 11, wherein the wall of the blind bore is tapered.

13. An improved switch for a high-voltage device; the switch being of the type in which ignition of a power cartridge benerates pressure at one end of an insulative piston to move the piston, which is normally located in a first bore formed in a first stationary contact, away therefrom and into a passageway formed in an insulative liner, such movement of the piston moving a movable contact through the passageway and into a second bore formed in a second stationary contact, such movement of the movable contact breaking electrical interconnections between the stationary contacts and the movable contact to form respective first and second gaps, thereby opening the switch; the bores and the passageway being aligned; wherein the improvement comprises:

an insulative lip seal located in the first bore between the power cartridge and the one end of the piston, the lip seal being movable with the piston and being conformally force fit into the first bore, and means for limiting movement of the lip seal through the first bore so that the lip seal remains in the first bore after the switch is open, the force fit of the lip seal in the first bore restricting or preventing the flow of the ignition products of the power cartridge therepast.

14. An improved switch as in claim 13, wherein the lip seal is configured so that ignition of the power cartridge applies force thereto which outwardly expands the lip seal into continuous, firm engagement with the first bore.

15. An improved switch as in claim 14, wherein the lip seal contains a blind bore facing the power cartridge.

16. An improved switch as in claim 15, wherein the wall of the blind bore is tapered.

17. An improved switch as in claim 13, 14 or 15, wherein the lip seal and the piston are separate members.

18. An improved switch as in claim 13, 14 or 15, wherein the lip seal is formed integrally with the piston at the one end thereof.

19. An improved switch as in claim 13, 14 or 15, wherein the lip seal is made of polymethylpentene or ultra high molecular weight polyethylene.

* * * * *

UNITED STATES PATENT AND TRADEMARK OFFICE

CERTIFICATE OF CORRECTION

PATENT NO. : 4,499,446

DATED : February 12, 1985

INVENTOR(S) : Roy T. Swanson

It is certified that error appears in the above-identified patent and that said Letters Patent are hereby corrected as shown below:

Column 2, line 51, "thus" should be --ultra--.

Column 2, line 53, "]926" should be --'926--.

Column 5, line 17, "17" should be --22--.

Column 7, line 34, after "ignition" insert --products--.

Column 7, line 50, "pentene(" should be --pentene (--.

Column 10, line 10, "benerates" should be --generates--.

Signed and Sealed this

*Eighteenth* Day of *June 1985*

[SEAL]

*Attest:*

DONALD J. QUIGG

*Attesting Officer*

*Acting Commissioner of Patents and Trademarks*